US006371804B1

(12) United States Patent
Kuo et al.

(10) Patent No.: US 6,371,804 B1
(45) Date of Patent: Apr. 16, 2002

(54) RETENTION MEANS FOR A CABLE CONNECTOR ASSEMBLY

(75) Inventors: Chin Pao Kuo, Tu-Chen; Weng Chung Hsieh, Tao-Yuan, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/590,437

(22) Filed: Jun. 9, 2000

Related U.S. Application Data

(63) Continuation-in-part of application No. 09/473,453, filed on Dec. 28, 1999.

(30) Foreign Application Priority Data

Dec. 21, 1999 (TW) ..... 088221796

(51) Int. Cl.[7] ..... H01R 13/73

(52) U.S. Cl. ..... 439/573; 439/954

(58) Field of Search ..... 439/954, 573

(56) References Cited

U.S. PATENT DOCUMENTS 5,445,540 A * 8/1995 Barrand ..... 439/573

* cited by examiner

*Primary Examiner*—Gary Paumen
(74) *Attorney, Agent, or Firm*—Wei Te Chung

(57) ABSTRACT

An electrical connector assembly comprises a connector and a dielectric housing. The connector includes a case from which a first wing and a second wing. Each wing defines a through hole and an extending plane which is inclined relative to a bottom surface of the case. The housing on which the connector is mounted has an inclined base defining an opening and a first sleeve and a second sleeve. A top surface of each sleeve defines a mating surface, the two surfaces being parallel to one another and inclined relative to the base. After the plug of the connector is inserted through the opening of the housing, the mating surfaces mate with the extending planes of the corresponding wing and both the through holes and corresponding threaded recesses of the sleeves which are aligned in a vertical direction thereby facilitating an insertion of bolts to secure the connector to the housing.

1 Claim, 3 Drawing Sheets

RETENTION MEANS FOR A CABLE CONNECTOR ASSEMBLY (This is a continuation-in-part of the copending application Ser. No. 09/473,453 filed Dec. 28, 1999.)

BACKGROUND OF THE INVENTION

1. Field of the Invention

The present invention relates to a cable connector assembly, and particularly to a cable connector assembly with retention means which facilitates assembly of the cable connector to an application.

2. Brief Description of the Prior Art

A conventional cable connector assembly, as shown in FIG. 3, comprises a housing 60 and a cable connector 50 attached to an inclined portion of the housing 60 by a pair of bolts 7 so that the cable connector 50 can be readily mated with a complimentary connector, such as a USB computer connector. The connector 50 includes a pair of wings 52 perpendicularly extending from lateral sides of a rectangular case 51 of the connector 50. A pair of posts 61 projects from the housing 60 substantially perpendicular to the inclined portion of the housing 60. The connector 50 is adapted for insertion into the housing 60 through an opening defined between the posts 61. Since the posts 61 have the same height, the wings 52 secured to the posts 61 are parallel to the housing 60. However, the housing 60 in some applications, such as MP3, deviates from the horizontal and the wings 52 thus incline with the housing 60. The bolts 7, which extend through the wings 52 in a direction perpendicular to the wings 52, will have to be inserted from some non-vertical direction. The insertion of the bolts 7 is therefore difficult and carries a risk of mismatch between the bolts 7 and the posts 61.

Hence, an improved electrical connector is required to overcome the disadvantages of the prior art.

BRIEF SUMMARY OF THE INVENTION

A first object of the present invention is to provide a cable connector assembly which has a connector adapted to be facilely and reliably secured to a housing.

To achieve the above-mentioned object, a connector includes a rectangular dielectric case, a shell depending from the case, a plug portion depending from the shell, and a signal cable extending from a top end of the case. A plurality of terminals of the connector is secured in the plug portion. A housing consists of an inclined base, a pair of sleeves upwardly extending at an angle to the base, and an opening defined between the sleeves. Each sleeve defines a mating surface at an upper side thereof and a threaded recess. The mating surfaces are horizontal and inclined to the base while the recesses extend in a vertical direction.

The case has a first wing and a second wing extending from lateral sides thereof. The first wing and the second wing each define an extending plane at a bottom side thereof for horizontally mating with the mating surfaces of the sleeves.

In assembly, the connector moves downwardly from a top side of the housing. The plug portion extends through and beyond the opening of the housing while the shell fits within the opening. The wings thus touch the mating surfaces of the sleeves and the through holes of the wings align with the recesses of corresponding sleeves. It is a feature that through holes and the recesses are aligned in a vertical direction such that an insertion of bolts is essentially in a vertical direction.

Other objects, advantages and novel features of the invention will become more apparent from the following detailed description of the present embodiment when taken in conjunction with the accompanying drawings.

DETAILED DESCRIPTION OF THE INVENTION

Figure 1:
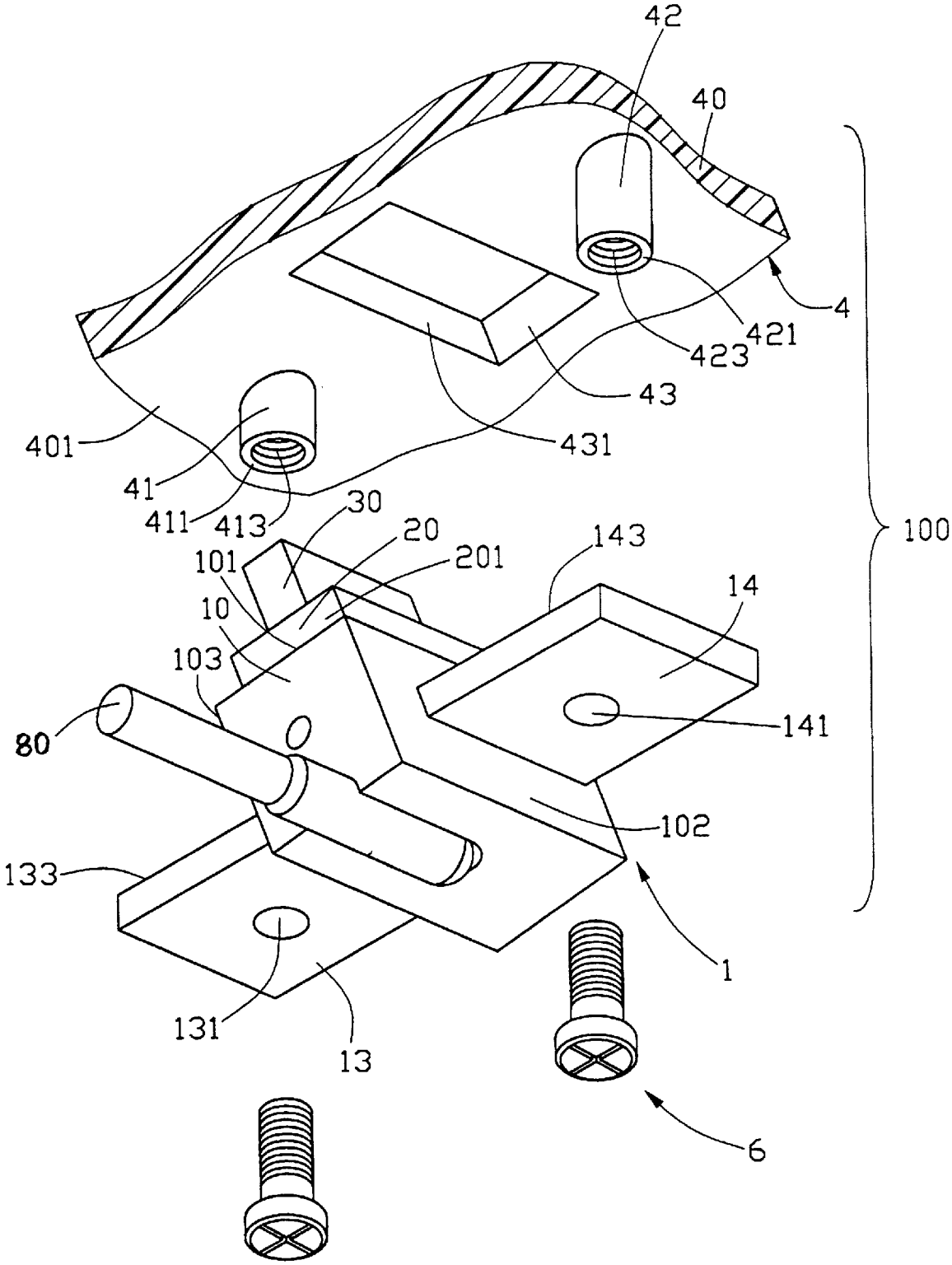
FIG. 1 is a schematic view of a cable connector assembly of the present invention.

Referring to FIG. 1, an electrical cable connector assembly 100 of the present invention comprises a cable connector 1, a dielectric housing 4, and a pair of bolts 6. The cable connector 1 includes a rectangular dielectric case 10, a shell 20, a plug portion 30 projecting downwardly from the shell 20, and a signal cable 80 extending from a top end of the case 10. A plurality of terminals (not shown) of the connector 1 is secured in the plug portion 30 for establishing an electrical connection with a complementary connector (not shown). The housing 4 includes a dielectric base 40 which is inclined from the horizontal, a first sleeve 41 and a second sleeve 42 extending upwardly at an angle from the base 40.

The rectangular case 10 forms a bottom surface 101 around the shell 20 and opposite lateral side surfaces 102, 103. The shell 20 is surrounded by the case 10 at an upper end thereof and provides outer surfaces 201 at a lower end thereof below the case 10.

A first wing 13 and a second wing 14 are integrally formed with the case 10. The first wing 13 and the second wing 14 project outwardly respectively from the side surfaces 102 and 103 of the case 10 and each wing defines on an underside thereof an extending plane 133, 143, which are inclined relative to the bottom surface 101 of the case 10. Two through holes 131 and 141 are respectively defined in the first wing 13 and the second wing 14.

Two mating surfaces 411, 421 are respectively formed on the first sleeve 41 and on the second sleeve 42 and are disposed at different heights above the base 40. In the preferred embodiment, the mating surfaces 411, 421 are horizontal when the housing 4 is fixed in application. The base 40 further has a top surface 401 and defines a rectangular opening 43 between the first sleeve 41 and the second sleeve 42. The opening 43 defines peripheral surfaces 431 at sides thereof.

Figure 2:
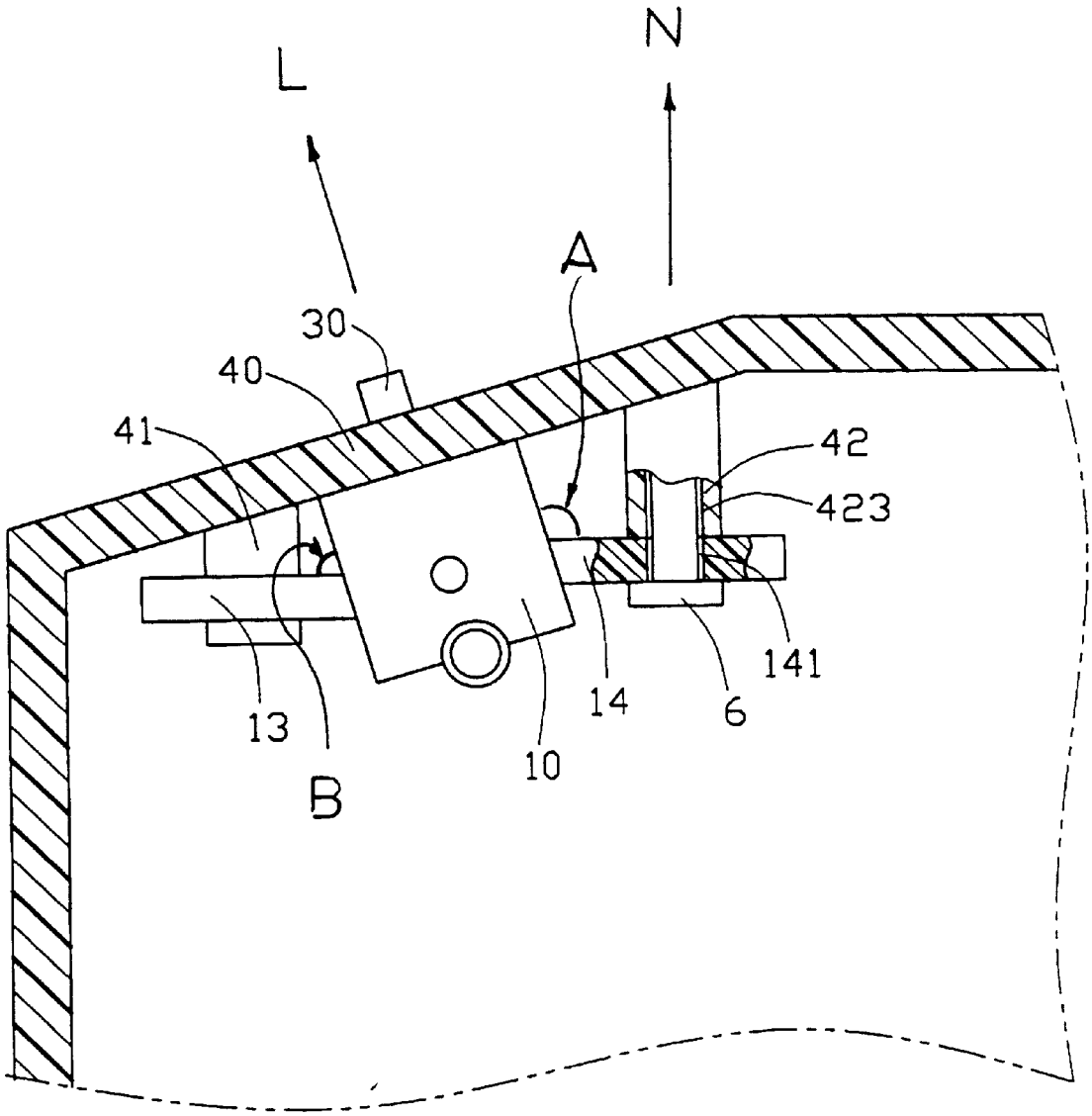
FIG. 2 is an assembled view of FIG. 1 with a partially sectional view showing a wing of the cable connector and a sleeve of a housing.

In assembly, further referring to FIG. 2, the connector 1 extends through the opening 43 in the base 40 from a top side of the housing 4. The bottom surface 101 of the case 10 presses against the top surface 401 of the base 40 around the opening 43 of the base 40 while the outer surfaces 201 of the shell 20 cooperate with the peripheral surfaces 431 of the opening 43. The plug portion 30 of the connector 1 thus extends beyond the opening 43. The wings 13 and 14 then touch the mating surfaces 411, 421 of the sleeves 41, 42 while the through holes 131, 141 of the wings 13, 14 respectively align with threaded recesses 413, 423 defined through corresponding sleeves 41, 42. The bolts 6 are then inserted through the through holes 131, 141 and respectively screwed into the threaded recesses 413, 423. In the preferred embodiment, when the extending planes 133, 143 of the wings 13, 14 mate with corresponding mating surfaces 411, 421, the through holes 131, 141 and the recesses 413, 423 are aligned in a vertical direction and at same time are inclined to the base 40. Therefore, the bolts 6 are substantially vertically inserted into the sleeves 41, 42 and the insertion of the bolts is thereby facilitated. The connector 1 is, therefore, facilely and reliably secured to the housing 4 by the bolts 6.

As will be understood by those of ordinary skill in the art, the extending planes 133, 143 of the wings 13, 14 are adapted to be either coplanar or parallel to each other, and furthermore, the present invention also includes embodiments wherein the extending planes 133, 143 are desired to be at an angle X relative to the horizontal and the base 40 is fixed at an angle Y relative to the horizontal, the angles X and Y being different. In opposite, the prior art as shown in FIG. 3 basically discloses the base 40 and the planes 133, 143 are parallel to each other, thus angles X and Y being same with each other.

Figure 3:
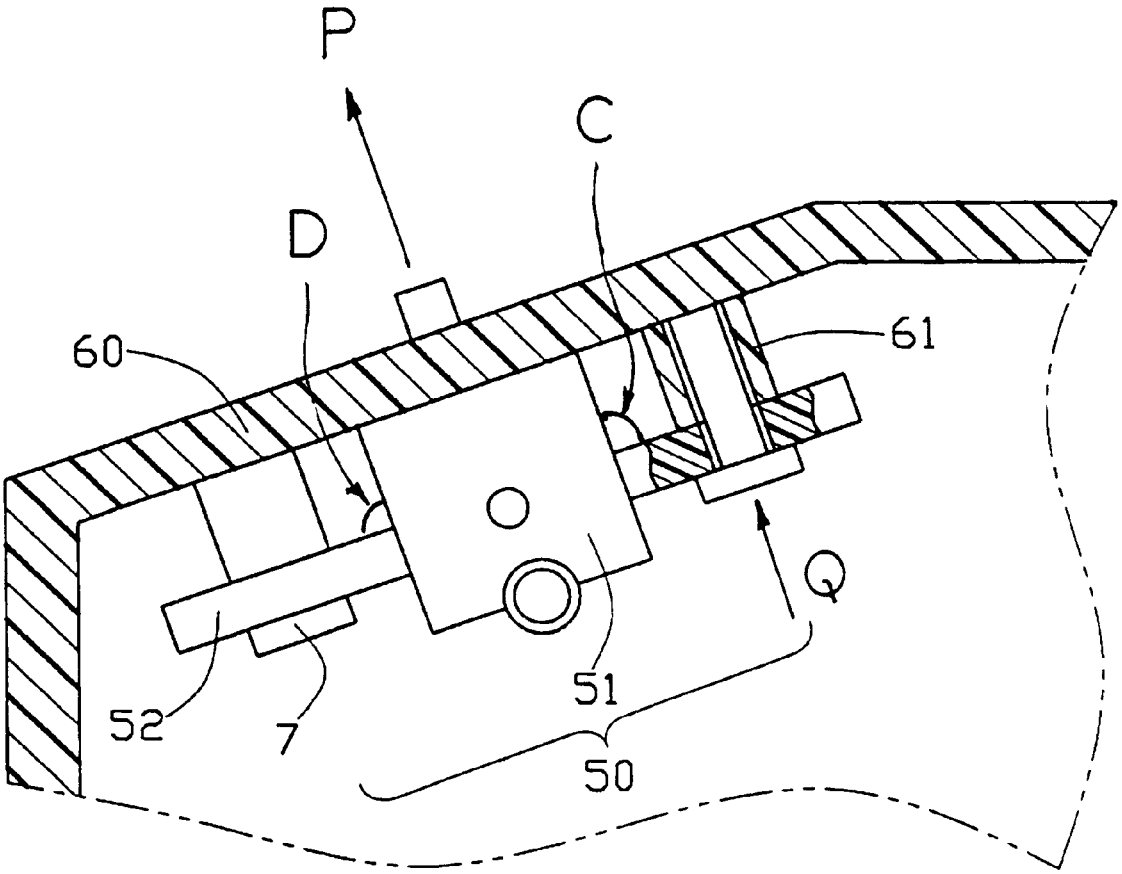
FIG. 3 (PRIOR ART)
FIG. 3 is an assembled view of a conventional cable connector assembly.

It is also appreciated that in the prior art of FIG. 3, the mating or the installation direction P of the connector is parallel to the securement direction Q of the screw of the connector. Differently, in the invention as shown in FIG. 2, the mating or the installation direction L of the connector is not parallel to, but obliquely angled with the securement direction N, thus relatively eliminating force-impact to the securement portion.

From another viewpoint, in the invention as shown in FIG. 2, the intersection angle A defined between the wing 14 and the case 10, and the intersection angle B defined between the wing 13 and the case 10 are not right angles while being mutually complementary angles. Differently, in the prior art as shown in FIG. 3, the corresponding intersection angles C and D are substantially right angles and complementary angles.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a connector including a dielectric case, a plug portion extending out of the case for mating with a complementary connector, and a plurality of terminals received in the plug portion, the dielectric case having a pair of resilient wings projecting from lateral sides of the dielectric case and each wing defining a through hole;

a housing including a base, two sleeves extending upwardly from a top surface of the base with each sleeve defining a threaded recess therethrough, and an opening in the base between the sleeves for extending the plug portion therethrough; and a pair of bolts for being inserted into the through holes and screwed into corresponding threaded recesses thereby mounting the connector onto the housing;

the improvement being:

each wing defines an extending plane at a bottom thereof wherein a line normal to the extending plane forms an acute angle relative to a normal of the top surface of the base, each sleeve defines a mating surface parallel to the corresponding extending plane and, after the plug portion of the connector is inserted through the opening of the base, axes of the through holes and corresponding threaded recesses are colinear and are parallel to the line normal to the corresponding extending plane whereby the bolts can be screwed into the threaded recesses along the axes;

wherein the wings obliquely extend from lateral sides of the case and are inclined relative to a bottom surface of the case for facilitating the bolts extending through the through holes;

wherein the mating plane defines a line normal thereto and the line is inclined at an acute angle to the normal of the top surface of the base for facilitating the insertion of the bolts;

wherein the extending planes are parallel to each other and extend substantially in a horizontal direction when assembled to the housing which is fixed at a fixed position;

wherein the mating surfaces are substantially in a horizontal direction and the recesses are essentially in a vertical direction when the housing is fixed in position;

wherein said base and said wings are not parallel to but angled with each other;

wherein said wings extend horizontally in a space under the base;

wherein each of said wings is angled relative to the case but not at a right angle;

wherein said pair of wings are parallel to but not coplanar with each other;

wherein said pair of sleeves have different lengths with each other;

wherein one of said pair of sleeves having a larger length engages one of the pair of wings having a larger intersection angle with the case, while the other of said pair of sleeves having a smaller length engages the other of said pair of wings having a smaller intersection angle with the case.

* * * * *